United States Patent [19]

Steinlein

[11] 4,210,265

[45] Jul. 1, 1980

[54] MOLDED CASE FOR RETURNABLE BEVERAGE BOTTLES

[75] Inventor: Rudolf F. Steinlein, Münichen, Fed. Rep. of Germany

[73] Assignee: Alexander Schoeller & Co. AG, Switzerland

[21] Appl. No.: 24,477

[22] Filed: Mar. 27, 1979

[30] Foreign Application Priority Data

Oct. 31, 1978 [CA] Canada ..... 315579

[51] Int. Cl.[2] ..... A47G 23/06; B65D 1/24; B65D 7/42

[52] U.S. Cl. ..... 224/48 A; 206/203; 206/427; 224/45 A; 220/21; 220/72

[58] Field of Search ..... 224/45 A, 48 A; 220/20, 220/21, 72; 206/203, 427, 429

[56] References Cited

U.S. PATENT DOCUMENTS

| | | | |
|---|---|---|---|
| 3,863,759 | 2/1975 | Prodel | 206/203 |
| 3,927,789 | 12/1975 | Prodel | 220/21 |
| 4,032,007 | 6/1977 | Graser et al. | 206/427 X |
| 4,067,474 | 1/1978 | Prodel | 206/427 X |

*Primary Examiner*—Steven M. Pollard

*Attorney, Agent, or Firm*—Roylance, Abrams, Berdo & Farley

[57] ABSTRACT

The disclosed case is of the type integrally molded from thermoplastic resin and rectangular, with a lattice floor. The outer bottom side of the floor is so formed as to facilitate nesting of the case on another. Four pillars extend vertically in two facing pairs from the floor, for separating bottles in the case sufficiently to prevent breakage in handling. The pillars of a pair are separated by a slot so that bottles can be accepted together with a carrier, with a wall of the carrier being slid into the aligned slots of the pillar pairs. The improvements in the case include that the pillars are open on their facing sides; there are inner longitudinal reinforcement ribs spaced to both sides of their spines, midway between the spine and the edges; a short web of material fills the gap between the facing edges of the pillars in the slot on each side of the slot adjoining the floor; the pillars are anchored to the floor lattice by anchoring points which include at least points located on the outside of the pillars directly opposite the inner reinforcement ribs. These features stabilize the spacing between the pillars, so that they do not pull toward each other as a result of stresses developing after removal from the mold.

6 Claims, 3 Drawing Figures

MOLDED CASE FOR RETURNABLE BEVERAGE BOTTLES

BACKGROUND OF THE INVENTION

The present invention relates to molded thermoplastic resin cases for transport and handling of beverage bottles, particularly those suited to receive bottles which are in a carrier.

Plastic cases for beverage bottles are generally rectangular and have a floor which is a latticework of floor support ribs. The floor is made this way to minimize the weight of the case, to minimize any accumulation of debris in the case, and to make it easier to wash out. The inner space in the case is somehow divided into bottle receiving compartments suited to the bottle size to be accepted by it.

In one type of case the inner space is divided into compartments by a number of pillars which extend vertically from the floor. The pillars have a roughly cross-shaped cross-section and are placed so that they extend vertically in the space between a group of four bottles to keep the bottles spaced sufficiently that they do not break when they are jostled. In some cases of this type, the pillars are slotted in at least one direction, parallel to the side walls or to the end walls, to form a group of two or four facing pillars. This permits bottles to be accepted together with a hand carrier, such as a "six-pack" carrier of cardboard. Such a case is described, for example, in the U.S. Pat. No. 4,071,162, which is assigned to the same assignee as that of the rights to the present invention. One or more walls of the carrier are slid into the aligned slots of the pillars. The pillars enter the carrier through openings in the bottom of the carrier. The pillars thereby supplement the protection against breakage which is afforded by the carrier alone. When the bottles are returned empty without the carrier, they can be returned alone to the case and are then similarly protected by the pillars. This protection is very important, since inadequately protected empty bottles can easily develop hairline fractures which render them unsuitable for refilling, but which are very difficult to reliably detect.

A persistent problem with cases of the type described above having slotted pillar groups has been that with certain configurations of the floor lattice, particularly a cartesian or rectangular configuration, the pillars of a group move together after the molding of the case, thereby impairing the loading of a carrier into the case due to insufficient slot clearance for readily accepting the carrier wall in the slot. This reduced slot clearance is a result of warping which occurs upon cooling of the case after demolding. Yet, for material economy and other structural reasons it is often preferred to use a cartesian floor lattice pattern.

SUMMARY OF THE INVENTION

In accordance with the present invention, the pillars and their attachment to the floor of a novel case are such that there is no significant dimensional change of the slot after case demolding. everal features in combination provide the dimensional stability for the slot. The pillars are open on their facing sides and have inner reinforcement ribs extending upwards. Near the bottom of the slot and on each side there is a short web filling in the slot. The anchoring points which fix the pillars to the floor include at least points located on the outside of the pillars directly opposite the inner reinforcement ribs.

DESCRIPTION OF A PREFERRED EMBODIMENT

Figure 1:
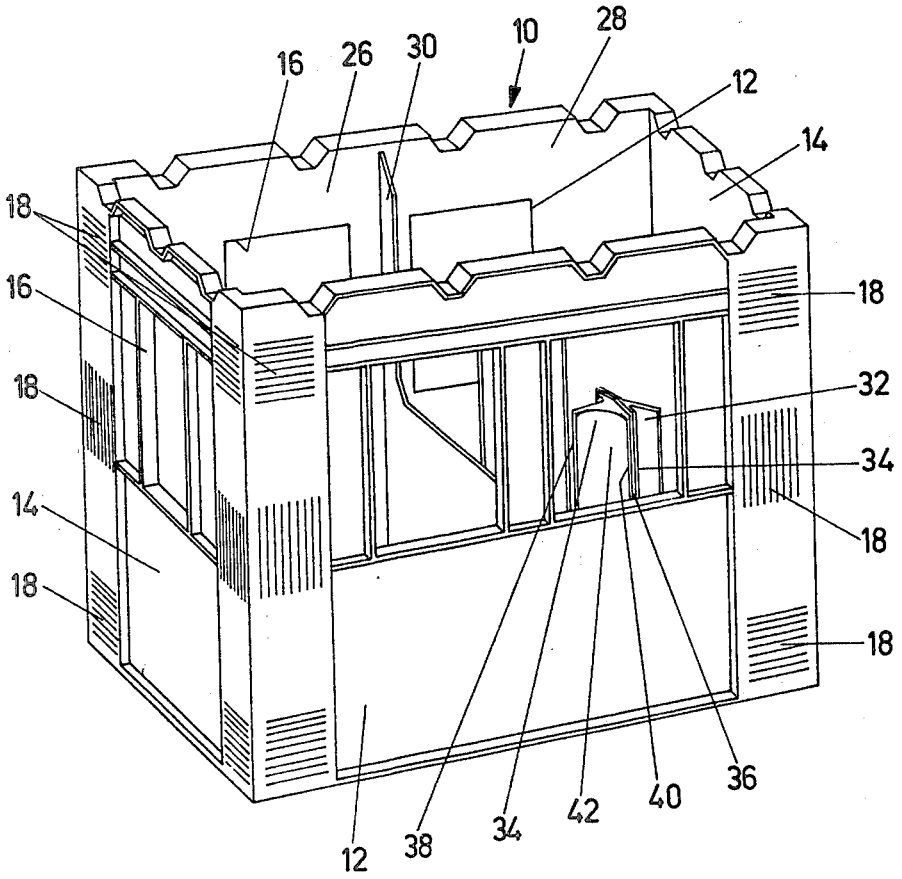
FIG. 1 is a front perspective view of a case in accordance with a preferred embodiment of the present invention, showing in phantom lines a carrier received in the case.
Figure 2:
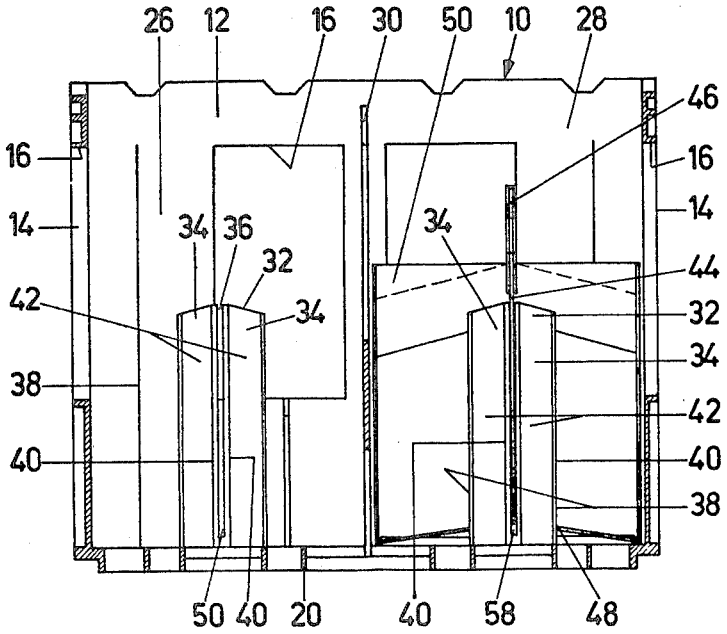
FIG. 2 is a cross-sectional exposed side view of one half of the case of FIG. 1, also with a carrier shown in one side compartment.
Figure 3:
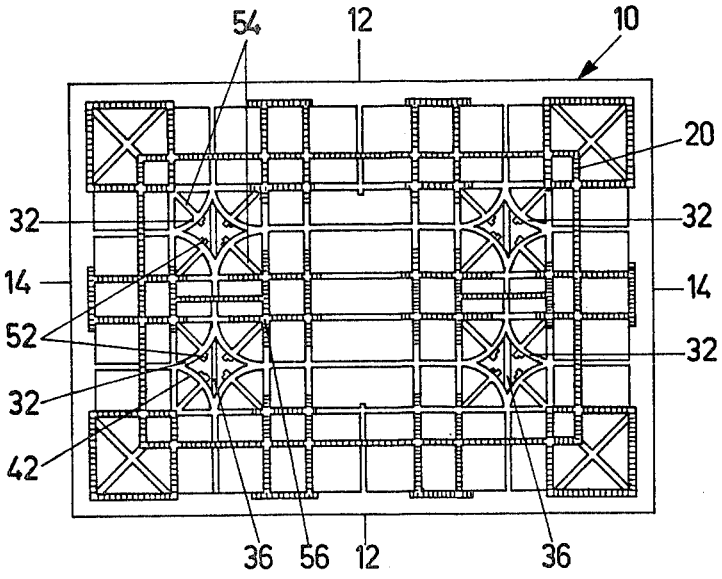
FIG. 3 is plan view of the bottom of the case of FIGS. 1 and 2 showing the anchoring of the pillars of the case to the floor lattice.

A preferred embodiment of the present invention is the novel case 10 shown in the FIGS. 1–3 of the drawings. Referring now to FIG. 1, the case 10 has a rectangular configuration, with two elongated side walls 12 which are mutually parallel and spaced from one another and two end walls 14 which join together the ends of the side walls 12. Both the side walls 12 and the end walls 14 have hand holes 16 in them to permit lifting of the case 10 by any wall. At various locations on the side and the end walls 12, 14 there are provided sets of locking ribs 18 which prevent the case 10 from sliding back and forth or up and down relative to another case of a similar nature pressed against it in a stacked arrangement such as is used in transport.

Extending between the bottom edges of the side and end walls 12, 14 is a floor lattice 20 made up of support ribs 22 running in a generally cartesian pattern, so that the majority of the individual support ribs 22 are either parallel to the side walls 12 or to the end walls 14. The floor support ribs 22 extend out beyond the edges of the side and end walls 12, 14, so that the bottom edges of the side and end walls 12, 14 become shoulders which permit the nesting of the case 10 on another case similar to it. There are additionally provided locking channels 24 in the bottom side of the floor lattice support ribs 22 to facilitate nesting of cases in a staggered stacking arrangement for better security in transport.

The interior space of the case 10 is divided into two case compartments 26, 28 of equal size by a case partition 30.

Extending vertically from the floor lattice 20 in each of the case compartments 26, 28 are two aligned pillar groups 32, each composed of two closely-spaced pillars 34 with a narrow slot 36 between them. Each pillar 34 has a crossection which is generally T-shaped as seen from the top, and in the shape of a double bracket elsewhere. Thus each column has a spine 38 corresponding to the junction of the brackets of the crossection, and two edges 40, one to each side of the spine 38. Between the spine 38 and each edge 40 of the pillars 34 is a concave cylindrical contact face 42 with a radius of curvature suited to the diameter of bottles to be accepted by the case 10. It can be visualized that the pillars 34 define in each case compartment 26 six receiving locations for bottles. The pillars 34 are of such dimensions that the received bottles are separated from each other by them to avoid breakage.

The pillars 34 are spaced from each other so that the slot 36 between them can accept the central partition 44 of a carrier, such as the carrier 46 shown in phantom lines in the FIG. 1. A pair of openings 48 in the bottom of the carrier 46 permit the pillar groups 32 to extend up into the carrier 46 with the central partition 44 of the carrier 46 lying in the aligned slots 36. The pillars 34 thereby become located in the individual carrier compartments 50 and afford protection of the bottles in addition to that provided by the carrier 46. When the returned, empty bottles are later placed into the case 10 without the carrier 46, which is generally not returned, the pillars 34 again provide the needed protection.

As can be seen from the FIGS. 2 and 3, the pillars 34 are hollow and open on their facing sides. Extending lengthwise on the inner surface of each pillar 34 and midway between the spine 38 and each of the edges 40 are reinforcing ribs 52. The reinforcing ribs 52 have an L-shaped cross-section, with the long leg of the L lying flat against the inner surface of the pillar 34.

Where each pillar 34 joins the floor lattice 20, it is anchored to a floor support rib 22 at each edge 40 and also at the spine 38. Additionally, there are short anchoring ribs extending from a support rib intersection to points directly opposite the reinforcement ribs 52 on the inner surface of the pillars 34 along a radius of the contact faces 42.

The slot space between facing edges 40 of facing pillars 34 near the floor lattice 20 is filled in by short webs 58. This effectively prevents the slots 36 from extending completely to the floor lattice 20 of the case 10. However, the webs 58 still do not interfere with the acceptance of the carrier 46, since carriers commonly have the bottom slightly raised in the center carrier partition region, as can be seen from the illustration of the carrier 46 in the FIG. 2.

The configuration of the pillars 34 with open facing sides, the inner reinforcement ribs 52, the webs 58 between the edges 40 of the facing pillars 34 in the slot 36, and the anchoring of the pillars 34 to the floor lattice 20 at points which include at least points located on the outside of the pillars 34 directly opposite the inner reinforcement ribs 22 results in a structure in which the slot spacing does not warp from the desired value upon demolding. Moreover, the pillars 34 are firmly and ruggedly anchored to the floor lattice 20 so that they cannot readily loosen from it. The absence of an inner facing wall for the pillars 34 has the further advantage that the pillars have excellent drainage of washing water in their upside-down position.

It should be understood that the features described above with respect to the preferred embodiment of the invention could also be used where pillars are in groups of more than two. For example, it might be desired to slot a group in both directions, such as would be the case if the pairs of facing pillars of described above were also provided a slot through the spines, so that there would be a group of four mutually facing inwardly curved pillars. While the features of the present invention are especially advantageous for cases with cartesian floor lattice patterns, the invention is useful for other floor patterns, such as those having radial sub-patterns.

I claim:

1. An integrally molded thermoplastic resin case for transporting beverage bottles, said case being of the type including:

a pair of parallel, spaced side walls;

a pair of parallel, spaced end walls perpendicular to said side walls and joined across the ends of said side walls;

a floor lattice of support ribs joining the bottom edges of said side and end walls to form a rectangular box-shaped case, and at least one facing, adjacent pair of separator pillars extending vertically from said floor lattice and having a slot therebetween for receiving therein a dividing wall of a bottle carrier to be inserted into said case together with bottles contained therein, wherein the improvement comprises that:

said pillars are open on their facing sides and have at least one cylindrically concave bottle contact face;

at least one longitudinal reinforcement rib is disposed substantially along the center line region of the inside surface of said pillar opposite said contact face;

a short web of material fills the gap between the facing edges of said pillars in said slot on each side of said slot adjoining said floor lattice, and said pillars are anchored to said floor lattice by anchoring points which include at least points located on the outside of said pillars directly opposite said inner reinforcement ribs.

2. The case according to claim 1, wherein each of said pillars comprises two cylindrically concave contact faces meeting along a common spine.

3. The case according to claim 2, wherein said reinforcement rib has an L-shaped cross-section.

4. The case according to claim 3, wherein said contact faces are substantially symmetrical with respect to said spine.

5. The case according to claim 4, wherein opposite each of said inner reinforcement ribs and at the outer wall of said pillars there is a junction with an anchoring rib which at its other end joins a floor support rib intersection.

6. The case according to claim 5, wherein said floor lattice is substantially a cartesian pattern at least in the region where said pillars are anchored.

* * * * *